US007593851B2

(12) United States Patent
Yang

(10) Patent No.: US 7,593,851 B2
(45) Date of Patent: Sep. 22, 2009

(54) PRECISION PIECEWISE POLYNOMIAL APPROXIMATION FOR EPHRAIM-MALAH FILTER

(75) Inventor: Rongzhen Yang, Shanghai (CN)

(73) Assignee: Intel Corporation, Santa Clara, CA (US)

( * ) Notice: Subject to any disclaimer, the term of this patent is extended or adjusted under 35 U.S.C. 154(b) by 1550 days.

(21) Appl. No.: 10/394,836

(22) Filed: Mar. 21, 2003

(65) Prior Publication Data

US 2004/0186710 A1 Sep. 23, 2004

(51) Int. Cl.
*G10L 21/02* (2006.01)

(52) U.S. Cl. ..... 704/228; 704/233; 704/230; 704/210

(58) Field of Classification Search ..... 704/226–228, 704/230, 256, 219, 210, 233, E21.004, E21.017
See application file for complete search history.

(56) References Cited

U.S. PATENT DOCUMENTS 5,012,519 A * 4/1991 Adlersberg et al. ..... 704/226
5,184,317 A * 2/1993 Pickett ..... 708/446
5,216,744 A * 6/1993 Alleyne et al. ..... 704/200
5,512,898 A * 4/1996 Norsworthy et al. ..... 375/222
5,768,473 A * 6/1998 Eatwell et al. ..... 704/226
5,933,802 A * 8/1999 Emori ..... 704/219
6,122,610 A * 9/2000 Isabelle ..... 704/226
6,415,253 B1 * 7/2002 Johnson ..... 704/210
6,952,482 B2 * 10/2005 Balan et al. ..... 381/94.1
7,260,526 B2 * 8/2007 Sall et al. ..... 704/226
2002/0002455 A1 * 1/2002 Accardi et al. ..... 704/226
2003/0002455 A1 * 1/2003 Kularatna et al. ..... 370/328
2003/0171918 A1 * 9/2003 Sall et al. ..... 704/216

OTHER PUBLICATIONS

Yariv Ephraim et al., "Speech Enhancement Using a Minimum Mean-Square Error Short-Time Spectral Amplitude Estimator", IEEE Transactions on Acoustics, Speech, and Signal Processing, vol. ASSP-32, No. 6, Dec. 1984, pp. 1109-1121.
Oliver Cappe, "Elimination of the Musical Noise Phenomenon with the Ephraim and Malah Noise Suppressor", IEEE Transactions on Speech and Audio Processing, vol. 2, No. 2, Apr. 1994, pp. 345-349.
Rainer Martin, "Noise Power Spectral Density Estimation Based on Optimal Smoothing and Minimum Statistics", IEEE Transactions on Speech and Audio Processing, vol. 9, No. 5, Jul. 2001, pp. 504-512.

* cited by examiner

*Primary Examiner*—Vijay B Chawan
(74) *Attorney, Agent, or Firm*—Blakely, Sokoloff, Taylor & Zafman LLP

(57) ABSTRACT

Precision piecewise polynomial approximation for Ephraim-Malah filter is described herein. In one embodiment, an exemplary process includes computing a first parameter based on Wiener filter weights and posterior signal-to-noise (SNR) via a polynomial approximation mechanism without using a mathematical division operation, and generating Ephraim-Malah filter coefficients based on the first parameter. Other methods and apparatuses are also described.

30 Claims, 9 Drawing Sheets

PRECISION PIECEWISE POLYNOMIAL APPROXIMATION FOR EPHRAIM-MALAH FILTER

FIELD

Embodiments of the invention relate to the field of speech enhancement; and more specifically, to precision piecewise polynomial approximation for Ephraim-Malah filter.

BACKGROUND

The problem of enhancing speech degraded by uncorrelated additive noise has recently received much attention. This is due to many potential applications a successful speech enhancement system can have, and because of the available technology which enables the implementation of such intricate algorithms.

It has been reported that the noise suppression rule proposed by Ephraim and Malah makes it possible to obtain a significant noise reduction, which leads to an Ephraim-Malah filter weights formula. In one approach, the original Ephraim-Malah filter weights formula has been implemented in a floating-point implementation. Although such implementation provides enough data precision, it lacks efficiency in performance. In another approach, the Ephraim-Malah filter weights formula has been implemented with a fix-point implementation using a traditional curve-fit method, such as polynomial approximation with Taylor's formula. Although such implementation provides efficiency in performance, it lacks data precision.

BRIEF DESCRIPTION OF THE DRAWINGS

The invention may best be understood by referring to the following description and accompanying drawings that are used to illustrate embodiments of the invention. In the drawings.

DETAILED DESCRIPTION

Figure 1:
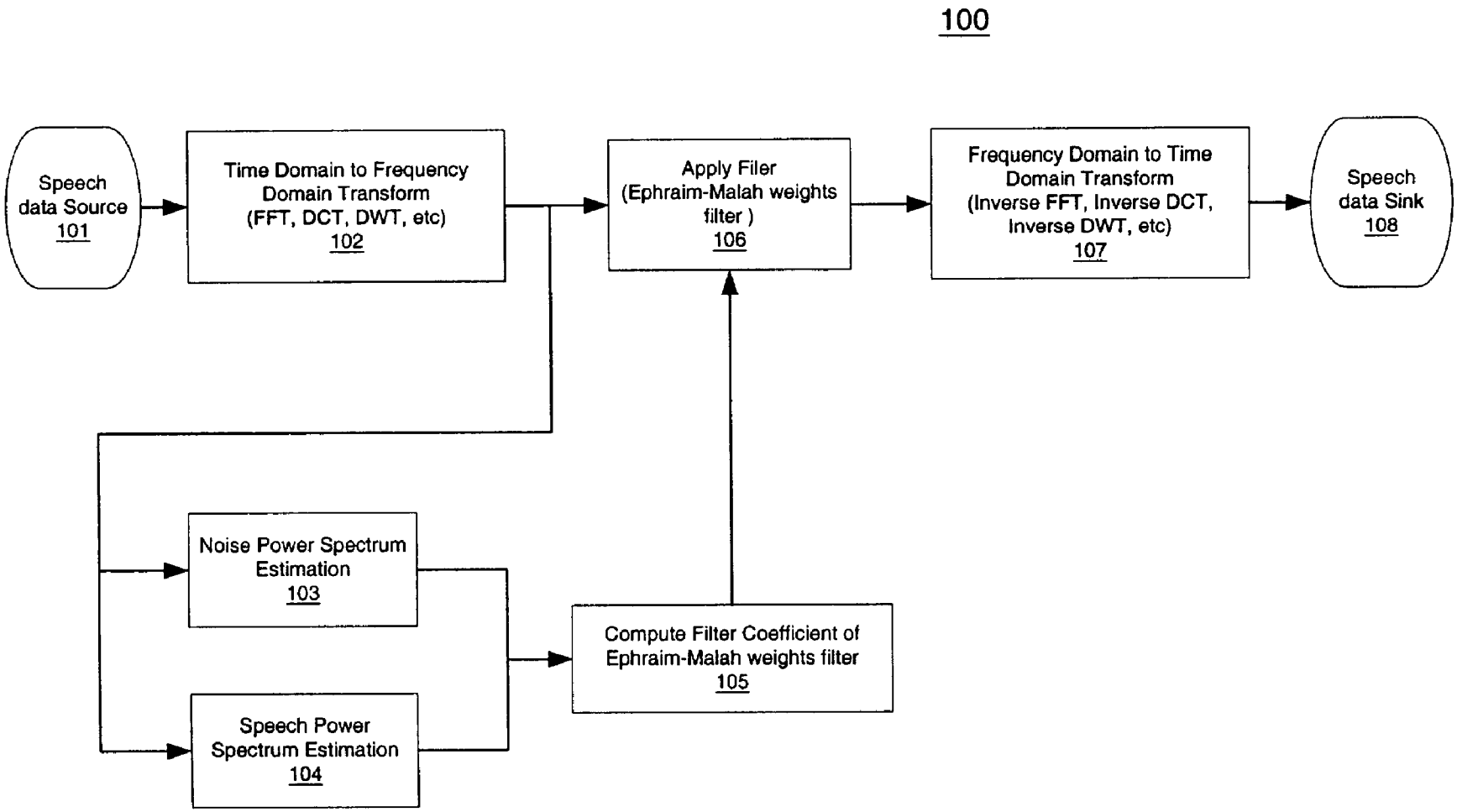
FIG. 1 is block diagram illustrating an exemplary embodiment of a speech enhancement system based on an Ephraim-Malah filter.

Precision piecewise polynomial approximation for Ephraim-Malah filter is described herein. In the following description, numerous specific details are set forth. However, it is understood that embodiments of the invention may be practiced without these specific details. In other instances, well-known circuits, structures and techniques have not been shown in detail in order not to obscure the understanding of this description.

Some portions of the detailed descriptions which follow are presented in terms of algorithms and symbolic representations of operations on data bits within a computer memory. These algorithmic descriptions and representations are used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar data processing device, that manipulates and transforms data represented as physical (e.g. electronic) quantities within the computer system's registers and memories into other data similarly represented as physical quantities within the computer system memories or registers or other such information storage, transmission or display devices.

Embodiments of the present invention also relate to apparatuses for performing the operations described herein. An apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs) such as Dynamic RAM (DRAM), EPROMs, EEPROMs, magnetic or optical cards, or any type of media suitable for storing electronic instructions, and each of the above storage components is coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the methods. The structure for a variety of these systems will appear from the description below. In addition, embodiments of the present invention are not described with reference to any particular programming language. It will be appreciated that a variety of programming languages may be used to implement the teachings of the embodiments of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; electrical, optical, acoustical or other form of propagated signals (e.g., carrier waves, infrared signals, digital signals, etc.); etc.

FIG. 1 is a block diagram illustrating an exemplary embodiment of an Ephraim-Malah noise suppressor which a precision piecewise polynomial approximation process may be used. In one embodiment, exemplary noise suppressor 100 includes speech data source 101, time domain to frequency domain (T/F) transform module 102, noise power spectrum estimation module 103, speech power spectrum estimation module 104, filter coefficient computing module 105, applying filter module 106, frequency domain to time domain (F/T) transform module 107, and speech data sink 108.

Referring to FIG. 1, according to one embodiment, speech data received from data source 101 may include an input block having the most recently acquired N/2 input samples $\zeta_n$ and the previous N/2 input samples $\zeta_{n-1}$ which make up a new input block $z_n$, such as:

$$z_n = \begin{bmatrix} \zeta_{n-1} \\ \zeta_n \end{bmatrix}$$

When T/F transform module 102 receives speech data from data source 101, the input block is multiplied by a square root of a window function. The window function may be constructed such that when its first half is added to its second half, all values add to one. In one embodiment, the window function is a triangular window, which may be defined as follows:

$$w(m) = \begin{cases} \dfrac{m+0.5}{N/2} & \text{for } m = 0, \ldots, N/2-1 \\ 1 - w(m - N/2) & \text{for } m = N/2, \ldots, N-1 \end{cases}$$

The discrete Fourier transform of the input may be calculated as follows:

$$Z_n = F(z_n \cdot \sqrt{w})$$

where · denotes point-wise multiplication and $\sqrt{w}$ denotes a vector containing the square root of the entries of w. F is the Fourier transform matrix with entries of:

$$f(m,n) = e^{-j2\pi\sqrt{mn}n/N}$$

where N is the size of the transform. The discrete Fourier transform can be replaced by FFT (fast Fourier transform), DCT (discrete cosine transform), or DWT (discrete wavelet transform), etc.

The data in frequency domain is then transferred to noise power spectrum estimation module 103 and speech power spectrum estimation module 104. In noise power spectrum estimation module 103, the noisy speech magnitude-squared spectral components are averaged to provide an estimate of the noisy speech power spectrum (e.g., power spectral density or PSD). In one embodiment, the estimation may be provided as:

$$P_n^z(k) = \beta_n \cdot |Z_n(k)|^2 + (1-\beta_n) \cdot P_{n-1}^z(k)$$

wherein adaptive step size $\beta_n$ is defined as:

$$\beta_n = \beta_{min} + \rho_{n-1}^y(\beta_{max} - \beta_{min})$$

where $\beta_{min}$=0.9, $\beta_{max}$=1.0, and $\rho_{n-1}^y$ is the likelihood of speech presence in frequency bin k. Frequency bin k is an index of coefficients in vector $Z_n$.

An estimation of the clean speech power spectral components is obtained by spectral subtraction and averaging performed by speech power spectrum estimation module 104. The estimation may be obtained by:

$$P_n^y(k) = \alpha_n \cdot |\hat{Y}_{n-1}(k)|^2 + (1-\alpha_n) \cdot \psi_0(P_n^z(k) - P_{n-1}^y(k))$$

where thresholding operator ψ is defined as $$\psi_c(x) = \begin{cases} c, & x \le c \\ x, & x > c \end{cases}$$

where adaptive step size $\alpha_n$ is defined as $$\alpha_n = \alpha_{min} + (1-\rho_{n-1}^y)(\alpha_{max} - \alpha_{min})$$

where $\alpha_{min}$=0.91, $\alpha_{max}$=0.95, and $\rho_{n-1}^y$ is the likelihood of speech presence in frequency bin k. Note that the previous frame's noise power spectral component is used in this calculation. If the noise floor estimator is independent of the rest of the algorithm, it may be possible to use the current frame's noise estimate instead.

One of the parameters used to compute the Ephraim-Malah suppression rule is the Wiener filter (a different noise suppression rule), which may be performed by filter coefficient module 105. The Wiener filter weights may be defined as follows:

$$W_n^y(k) = \psi_{W_{\min}}\left(\frac{P_n^y(k)}{P_n^y(k) + P_{n-1}^y(k)}\right)$$

where $W_{min}$ may be a threshold similar to the threshold defined by O. Cappe, entitled "Elimination of the Musical Noise Phenomenon with the Ephraim and Malah Noise Suppressor", IEEE Trans. Speech and Audio Processing., Vol. 2, No. 2, April 1994, pp. 345-349. In Cappe, it was recommended that a lower limit for a priori SNR, which is defined as follows:

$$\Re_n^{prio}(k) = \frac{P_n^y(k)}{P_{n-1}^y(k)}$$

where $\Re_{min\ dB}^{prio}$=−15.0 dB may be imposed to avoid musical noise. As a result, which may be transformed to:

$$W_{\min} = \frac{1}{1 + 10^{-\frac{\Re_{\min\ dB}^{prio}}{10}}}$$

Note that if the Wiener filter is written in terms of the a priori SNR, the Wiener filter calculation may be replaced by a table lookup, which will be described in details further below, according to one embodiment. This approach is particularly useful for processors where divisional operations are expensive.

A posteriori signal to noise ratio (SNR) for each frequency bin may be defined as follows:

$$\mathfrak{R}_n^{post}(k) = \frac{P_n^z(k)}{P_{n-1}^v(k)}$$

The Ephraim-Malah filter weights are given by:

$$H_n^y(k) = \frac{1}{\mathfrak{R}_n^{post}(k)} \cdot M(W_n^y(k)\mathfrak{R}_n^{post}(k))$$

where M(·) is a function defined by:

$$M(\theta) = \frac{1}{2} \cdot \sqrt{\pi\theta} \cdot e^{-\frac{\theta}{2}}\left[(1+\theta) \cdot I_0\left(\frac{\theta}{2}\right) + \theta \cdot I_1\left(\frac{\theta}{2}\right)\right]$$

Typically, a noise power spectral estimator may be employed to calculate $P_n^v(k)$. Such estimator may be constructed similar to those defined by R. Martin, "Noise Power Spectral Density Estimation Based on Optimal Smoothing and Minimum Statistics," IEEE *Trans. Speech and Audio*, Vol. 9, No. 5, July 2001, pp. 504-512.

In general, the probability of speech presence is not calculated directly. Rather, it is roughly approximated by the MMSE (minimum mean-square error) (Wiener) estimator of the overall speech energy, which is defined as follows:

$$\rho_n^y = \frac{\sum_{k=0}^{N/2} P_n^y(k)}{\sum_{k=0}^{N/2} P_n^y(k) + \sum_{k=0}^{N/2} P_n^v(k)}$$

The filter coefficients $H_n^v(k)$ may be modified to improve perceptual speech quality or reduce perceptible musical tones. For example, to efficiently handle loud, low-pass noise such as those encountered in automotive environments, low-frequency filter coefficients (e.g., below 60 Hz) may be set to zero. Thereafter, filter output may be calculated by applying filter module 106. The filter output may be defined as follows:

$$\hat{Y}_n(k) = H_n^y(k) \cdot Z_n(k)$$

Finally, time domain filter output is obtained by an inverse FFT, an inverse DFT, or an inverse DWT, etc., to generate final output at speech data sink 108. The time domain filter output is performed by F/T transform module 107 based on a formula similar to one defined below:

$$\hat{y}_{n-1} = \left[\begin{matrix} 0_{\frac{N}{2}\times\frac{N}{2}} & I_{\frac{N}{2}\times\frac{N}{2}} \end{matrix}\right] \cdot \sqrt{w} \bullet F^{-1}\hat{Y}_{n-1} + \left[\begin{matrix} I_{\frac{N}{2}\times\frac{N}{2}} & 0_{\frac{N}{2}\times\frac{N}{2}} \end{matrix}\right] \cdot \sqrt{w} \bullet F^{-1}\hat{Y}_n$$

As mentioned above, the original Ephraim-Malah filter weights formula includes complicated computation which some processors may not be able to offer. The original Ephraim-Malah filter weights formula is defined as follows:

$$H_n^y(k) = \frac{1}{\mathfrak{R}_n^{post}(k)} \cdot M(W_n^y(k)\mathfrak{R}_n^{post}(k)) \quad \text{(Eq. 1)}$$

where, M (·) is a function defined by:

$$M(\theta) = \frac{1}{2} \cdot \sqrt{\pi\theta} \cdot e^{-\frac{\theta}{2}}\left[(1+\theta) \cdot I_0\left(\frac{\theta}{2}\right) + \theta \cdot I_1\left(\frac{\theta}{2}\right)\right] \quad \text{(Eq. 2)}$$

where $I_0(\cdot)$ and $I_1(\cdot)$ is order 0 and order 1 of a modified Bessel function of the first kind, which is well known in the art. Further detailed information concerning the modified Bessel function of the first kind can be found at a Web site of:

http://mathworld.wolfram.com/ModifiedBesselFunction-oftheFirstKind.html $W_n^y(k)$ is the Wiener filter defined by:

$$W_n^y(k) = W_{\min}\left(\frac{P_n^y(k)}{P_n^y(k) + P_{n-1}^v(k)}\right) \quad \text{(Eq. 3)}$$

where $W_{min}$ is a threshold similar to one defined by O. Cappe, entitled "Elimination of the Musical Noise Phenomenon with the Ephraim and Malah Noise Suppressor," *IEEE Trans. Speech And Audio Processing*, Vol. 2, No. 2, April 1994, pp. 345-349. $P_n^y(k)$ is a clean speech PSD (Power Spectral Density) estimation provided by speech power spectrum estimation module 104. $P_n^v(k)$ is a noise PSD estimation provided by noise power spectrum estimation module 103.

The division operation in equation (1) is a bottleneck for performance of an implementation in software and hardware.

$$\text{Since } \frac{1}{\mathfrak{R}_n^{post}(k)} = \frac{W_n^y(k)}{W_n^y(k)\mathfrak{R}_n^{post}(k)},$$

the new

Ephraim-Malah filter weights may be transformed into:

$$H_n^y(k) = W_n^y(k) * M'(W_n^y(k)\mathfrak{R}_n^{post}(k))$$

where M'(·) is a function defined by:

$$M'(\theta) = \frac{1}{2} \cdot \sqrt{\frac{\pi}{\theta}} \cdot e^{-\frac{\theta}{2}}\left[(1+\theta) \cdot I_0\left(\frac{\theta}{2}\right) + \theta \cdot I_1\left(\frac{\theta}{2}\right)\right] \quad \text{(Eq. 4)}$$

where $I_0(\cdot)$ and $I_1(\cdot)$ are order 0 and order 1 of a modified Bessel function of the first kind respectively. With the new Ephraim-Malah filter weights formula, the division operation involved in Eq. 1 may be eliminated.

Figure 2:
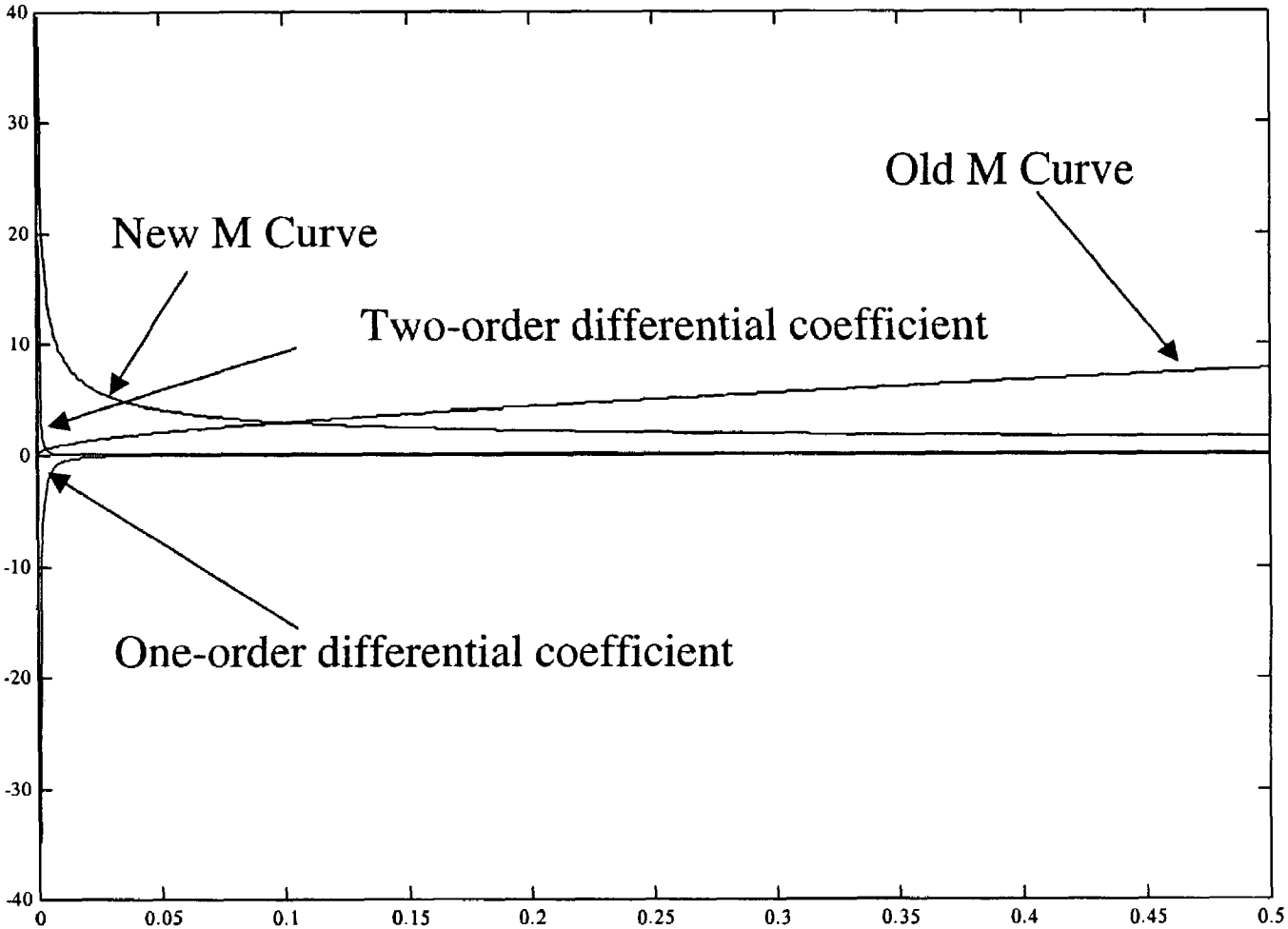
FIG. 2 is a chart illustrating an exemplary embodiment of a curve analysis.

FIG. 2 is graph illustrating an exemplary curve of a M'(·) function. Referring to FIG. 2, the dynamic range of curve is large when input value approaches zero. At a point of an input value having zero, the curve approaches ∞. Thus, if M'(·) is implemented via a general piecewise polynomial approximation, the big dynamic range would make the error be substantially large and it would approach ∞ when the input value is approaching zero. Typically, the general piecewise polynomial approximation uses average length band for piecewise polynomial approximation.

To solve this problem, a technique for exponential increasing piecewise polynomial approximations is introduced, according to one embodiment. For a fix-point implementation, the input value of M'(·) is represented with a Q22 format. Q format is used to represent a floating-point value using fix-point values. The position of the binary point in a fixed-point number determines how to interpret the scaling of the number. When the hardware performs basic arithmetic such as addition or subtraction, the hardware uses the same logic circuits regardless of the value of the scale factor. The logic circuits have no knowledge of a binary point. They perform signed or unsigned integer arithmetic as if the binary point is at the right of $b_0$, $b_0$ is the location of the least significant (e.g., lowest) bit. For example, according to one embodiment, a 32-bit data may be defined as data format 530 as shown in FIG. 5B, where MSB is the most significant (e.g., highest) bit and LSB is the least significant (e.g., lowest) bit.

In the DSP (digital signal processing) industry, the position of the binary point in the signed and fixed-point data types is expressed in and designated by a Q format notation. This fixed-point notation takes a form of Qm.n, where:

- Q designates that a number is in Q format notation (e.g., the representation for signed fixed-point numbers).
- m represents number of bits used to designate the two's complement integer portion of a number.
- n represents number of bits used to designate the two's complement fractional portion of a number, or number of bits to the right of the binary point.

In a Q format, the most significant bit is designated as a sign bit. Representing a signed fixed-point data type in a Q format requires m+n+1 bits to account for the sign. For example, Q15 is a signed 32-bit number with n=15 bits to the right of the binary point which is defined as Q16.15. In this notation, there is (1 sign bit)+(m=16 integer bits)+(n=15 fractional bits)=32 bits total in the data type. In a Q format notation, when Q16.15 is indicated the data type fixed on 32-bit, m=32−n−1 is often implied. As a result Q15 is used to represent Q16.15 instead.

Figure 3:
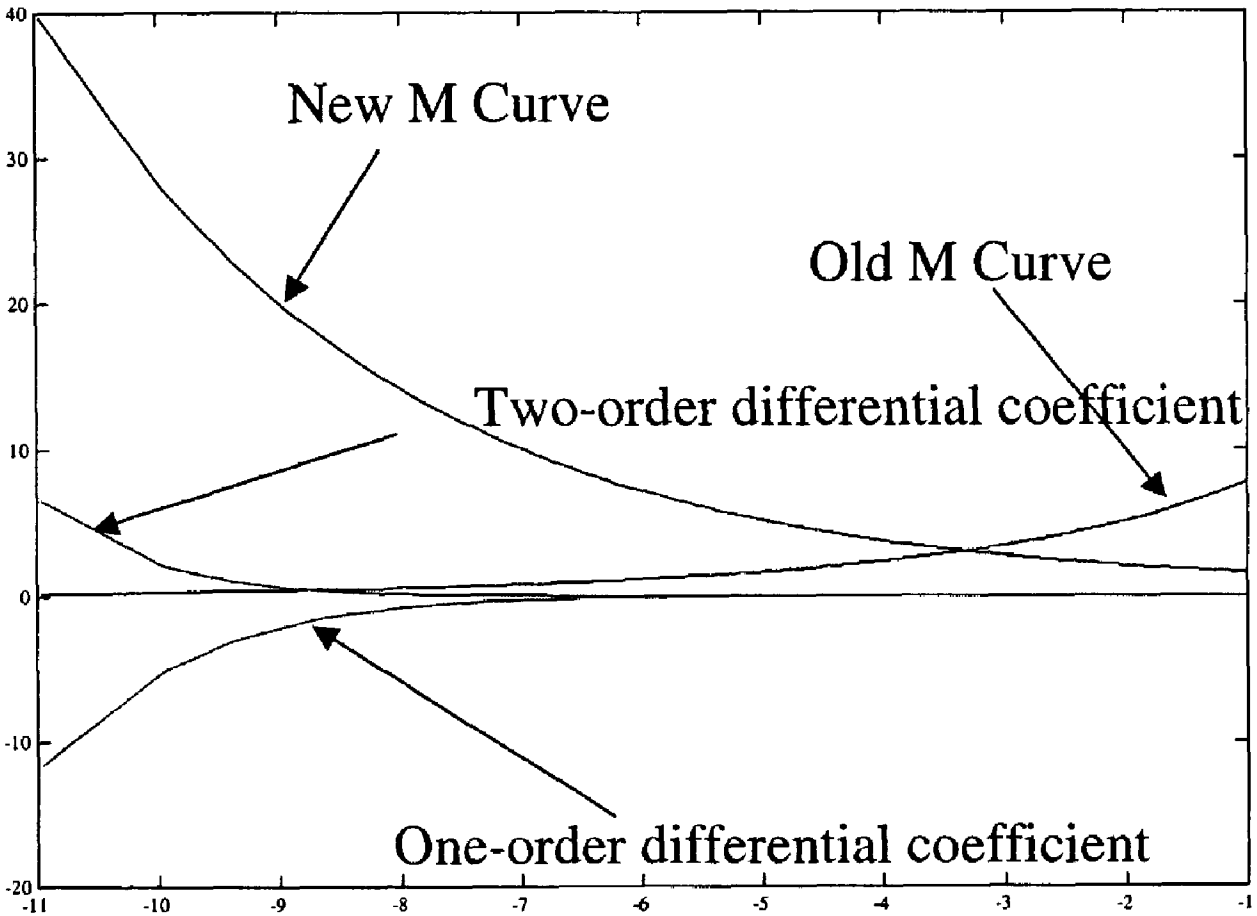
FIG. 3 is a chart illustrating an exemplary embodiment of a curve analysis with band mapping.

According to one embodiment, from $\theta=2^7$ to $2^{31}$, the range is divided into 24 bands, each band is defined as $[2^i, 2^{i+1})$, i=7 . . . 30. Each band is mapped to equal length cell to analyze the curve, as shown in FIG. 3. As shown in FIG. 3, exponential increasing piecewise approach limits the dynamic range and provides high precision for fix-point implementation. In the $i^{th}$ band $[2^i, 2^{i+1})$, a two-order polynomial approximation may be used to calculate the output result. In one embodiment, the two-order polynomial approximation may be defined as follows:

$$f(x)=P0+P1*x+P2*x^2 \quad \text{(Eq. 5)}$$

In general, a fixed Q value, such as Q31, Q15, is used for fix-point implementation. To achieve a high-precision output, a dynamic Q Value of parameters is designed. Referring to Eq. 5, since P1 and P2 change greatly in different band, dynamic Q value may be designed for parameter P1 and P2 to maintain high precision. In one embodiment, the Q value of P1 is (i+5) and the Q value of P2 is (i−4), where i is an index of the corresponding band (i from 0 to 23). The representation of P0 is defined as a Q22 format for all segments.

In one embodiment, P0 may be defined as follows:

```
P0[24] = {
  669498645,  473414302,  334764744,  236728959,  167413213,  118408092,
  83768274,   59291231,   42007360,   29819668,   21249233,   15255427,
  11108711,   8299601,    6470760,    5361107,    4756698,    4463049,
  4325745,    4259445,    4226742,    4210491,    4202389,    4198345
};
```

In one embodiment, P1 may be defined as follows:

```
P1[24] = {
  72453962,   51231813,   36225125,   25613282,   18108852,   12801395,
  9047010,    6390220,    4508716,    3174276,    2225121,    1546422,
  1056723,    698929,     435261,     245271,     121987,     56781,
  27183,      13368,      6635,       3306,       1650,       824
};
```

In one embodiment, P2 may be defined as follows:

```
P2[24] = {
  1576642499, 557423223,  197075987,  69674844,   24632335,   8707825,
  3077959,    1087711,    384201,     135577,     47749,      16748,
  5823,       1986,       648,        193,        49,         11,
  2,          0,          0,          0,          0,          0
};
```

Figure 4:
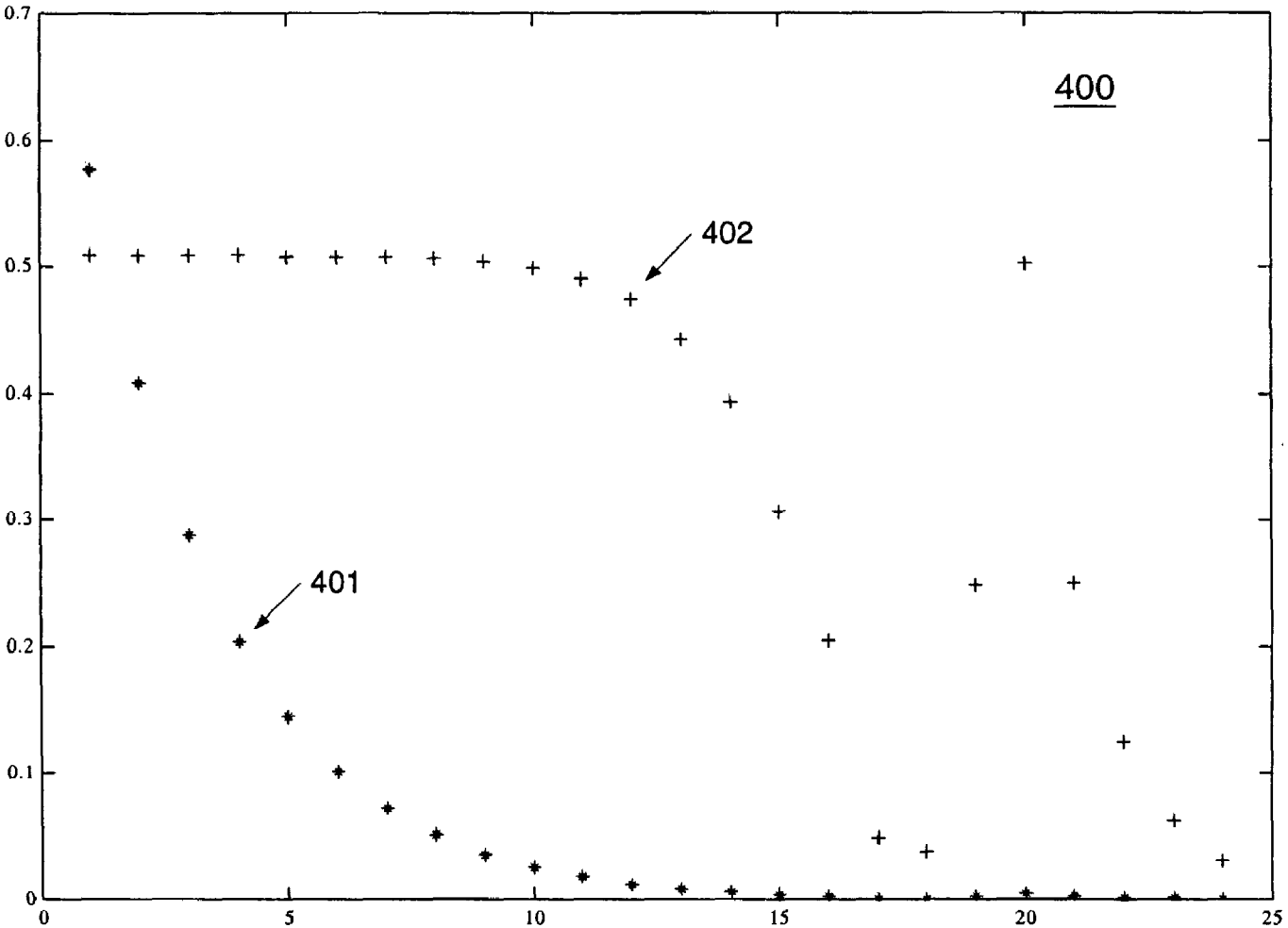
FIG. 4 is a chart illustrating an exemplary embodiment of an error result of a polynomial approximation process.

FIG. 4 is an error result of exponential increasing piecewise two-order polynomial approximations, according to one embodiment. Referring to FIG. 4, graph 402 represents the maximum absolute error of bands and graph 401 represents errors in percentage. As shown in FIG. 4, the maximum error percentage is less than 1%. The error of traditional curve-fit approach may reach nearly 50% when input value is approaching zero.

According to one embodiment, when the input value (Q22 format) of M'(·) is in a range of $(2^7, 2^{31})$, M'(·) is determined by exponential increasing piecewise two-order polynomial approximations with 24 bands, as described above. When the input value (Q22 format) of M'(·) is small, such as, for example, in a $[0, 2^7)$ range, it is not suitable to be used in a curve-fit method because the one-order differential coefficient and the two-order differential coefficient are changed greatly at different bands. As a result, according to one embodiment, a table is used for the small input value to achieve high precision. According to one embodiment, when a threshold is set as $2^7$, a table may be designed to have 129 values. It would be appreciated that other thresholds may be defined. Higher threshold would lead to higher performance since less computation is involved. However, data table associated with the threshold may be increased and more memory is needed. Therefore, a balance of resources may be required. In one embodiment, an exemplary data table may be defined as follows:

```
DIRECT_VALUE[129]=
{
2147483647,
1815, 1283, 1048, 907, 812, 741, 686, 642, 605, 574, 547, 524, 503, 485,
469, 454, 440, 428, 416, 406, 396, 387, 378, 370, 363, 356, 349, 343,
337, 331, 326, 321, 316, 311, 307, 303, 298, 294, 291, 287, 283, 280,
277, 274, 271, 268, 265, 262, 259, 257, 254, 252, 249, 247, 245, 243,
240, 238, 236, 234, 232, 231, 229, 227, 225, 223, 222, 220, 219, 217,
215, 214, 212, 211, 210, 208, 207, 206, 204, 203, 202, 200, 199, 198,
197, 196, 195, 193, 192, 191, 190, 189, 188, 187, 186, 185, 184, 183,
182, 182, 181, 180, 179, 178, 177, 176, 175, 175, 174, 173, 172, 172,
171, 170, 169, 169, 168, 167, 166, 166, 165, 164, 164, 163, 162, 162,
161, 160
};
```

Figure 5A:
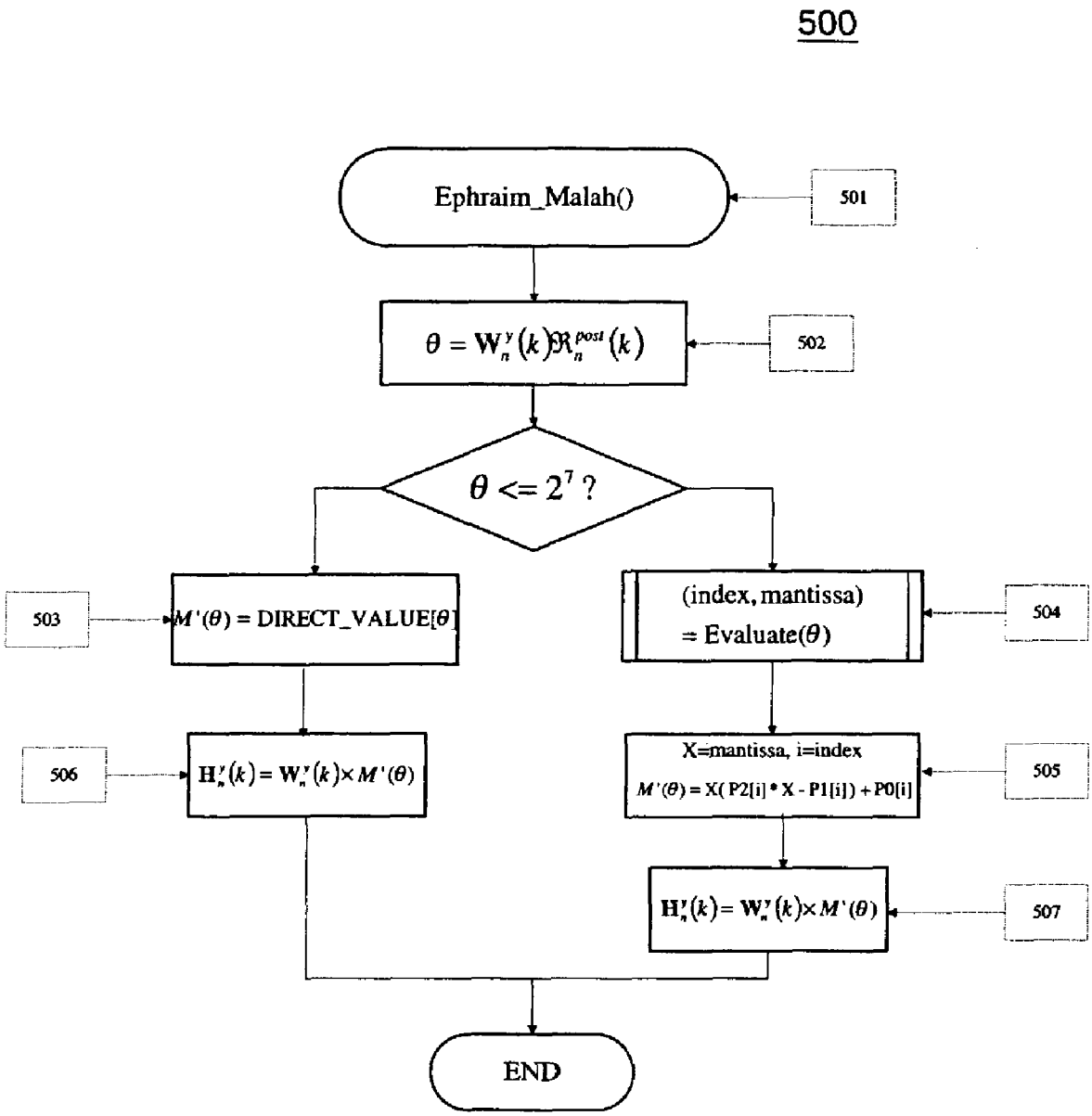
FIG. 5A is a block diagram illustrating an exemplary embodiment of a precision piecewise polynomial approximation of an Epharim-Malah filter weights formula.
Figure 5B:
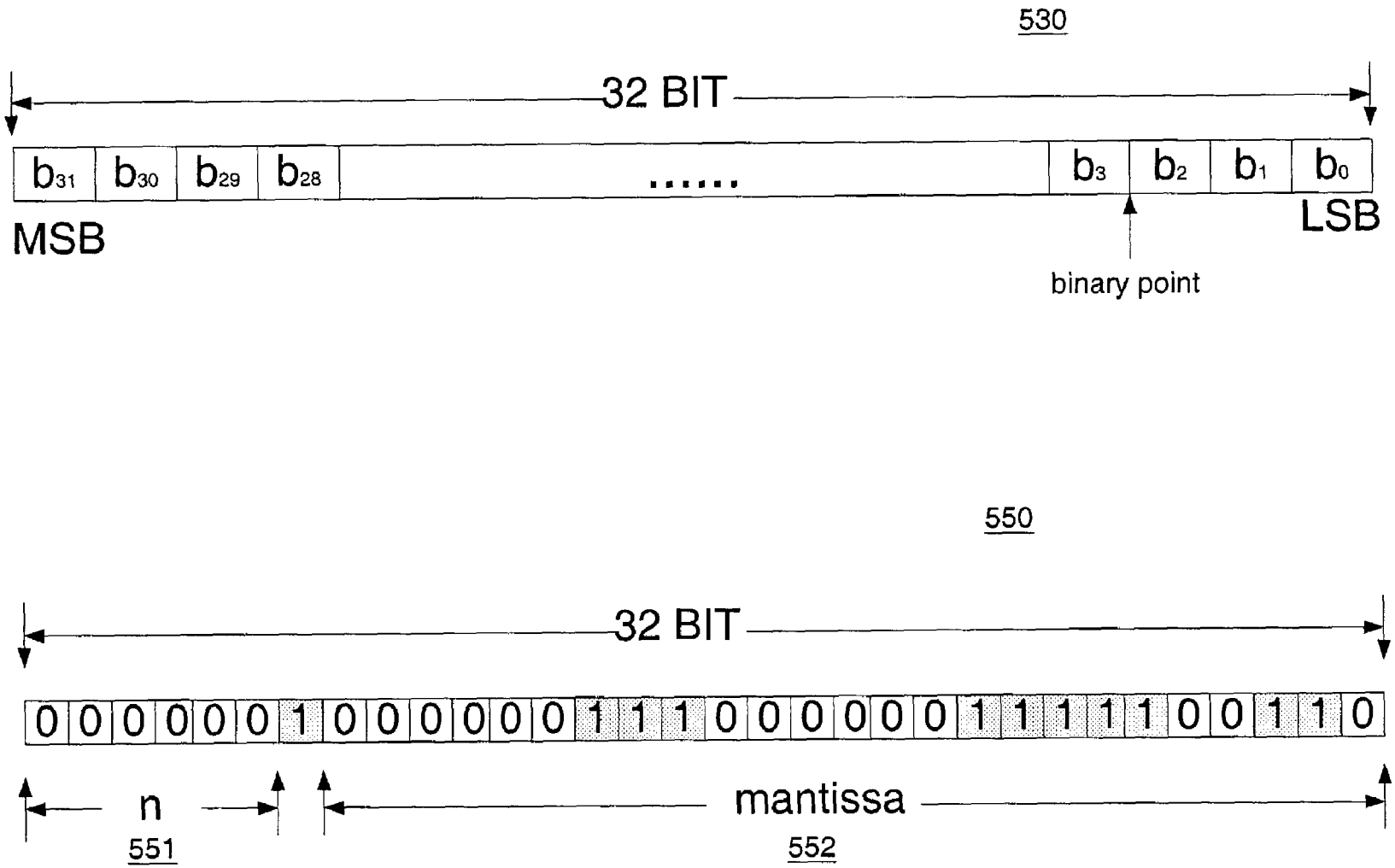
FIG. 5B is a block diagram illustrating an exemplary embodiment of a data format.

FIG. 5A is a block diagram illustrating exemplary embodiment of operations for high-precision implement algorithm of Ephraim-Malah filter weights formula. The operations may be performed by hardware (e.g., circuitry, dedicated logic, etc.), software (such as programs run on a general purpose computer or a dedicated machine), or a combination of both. Referring to FIG. 5A, at processing block 501, input parameters of function Ephraim_Mala( ) θ, which is a product of Wiener filter $W_n^y(k)$ and posterior SNR $\Re_n^{post}(k)$, is received by process logic, where k represents an index of frequency point.

For a fix-point implementation, according to one embodiment, $W_n^y(k)$ is implemented using Q31 format and $\Re_n^{post}(k)$ is implemented using Q15 format. At processing block 502, according to one embodiment, since θ is implemented in a Q22 format, the 0 may be obtained by process logic via following transformation:

$$\theta = W_n^y(k) \times \Re_n^{post}(k) >> (31+15-22) \quad \text{(Eq. 6)}$$

where >>represents a shift operation. In one embodiment, θ is a 32-bit value which is suitable for a 32-bit processor. It would be appreciated that θ may be implemented in other forms for other types of processor, such as 64-bit processors, etc.

If θ is greater than a predetermined threshold, such as $2^7$, at processing block 504, an index value and a mantissa value are extracted from θ, as shown as 32-bit number 550 in FIG. 5B according to an embodiment. Referring to FIGS. 5A and 5B, at processing block 504, function Evaluate (θ) extracts the index=24−n 551, mantissa 552. n is the number of leading zero bits at 32-bit number 550. For the example, as shown in FIG. 5B, index=24−6=18, mantissa 552=1110000001111100110 in binary, which is 459750 in decimal. In one embodiment, n 551 and mantissa 552 can be extracted through an instruction of a processor, such as, for example, Intel Xscale microprocessor with a CLZ instruction which is available from Intel Corporation.

At processing block 505, since X, which is a mantissa, such as mantissa 552, is implemented in a Q22 format. P0[i] is implemented in a Q22 format. P1[i] is implemented in a dynamic Q value, such as (5+i). P2[i] is implemented in dynamic Q value (i−4). Result M'(θ) is implemented in a Q22 format. In one embodiment, processing block 505 may be implemented in one or more major operations by process logic.

Figure 6:
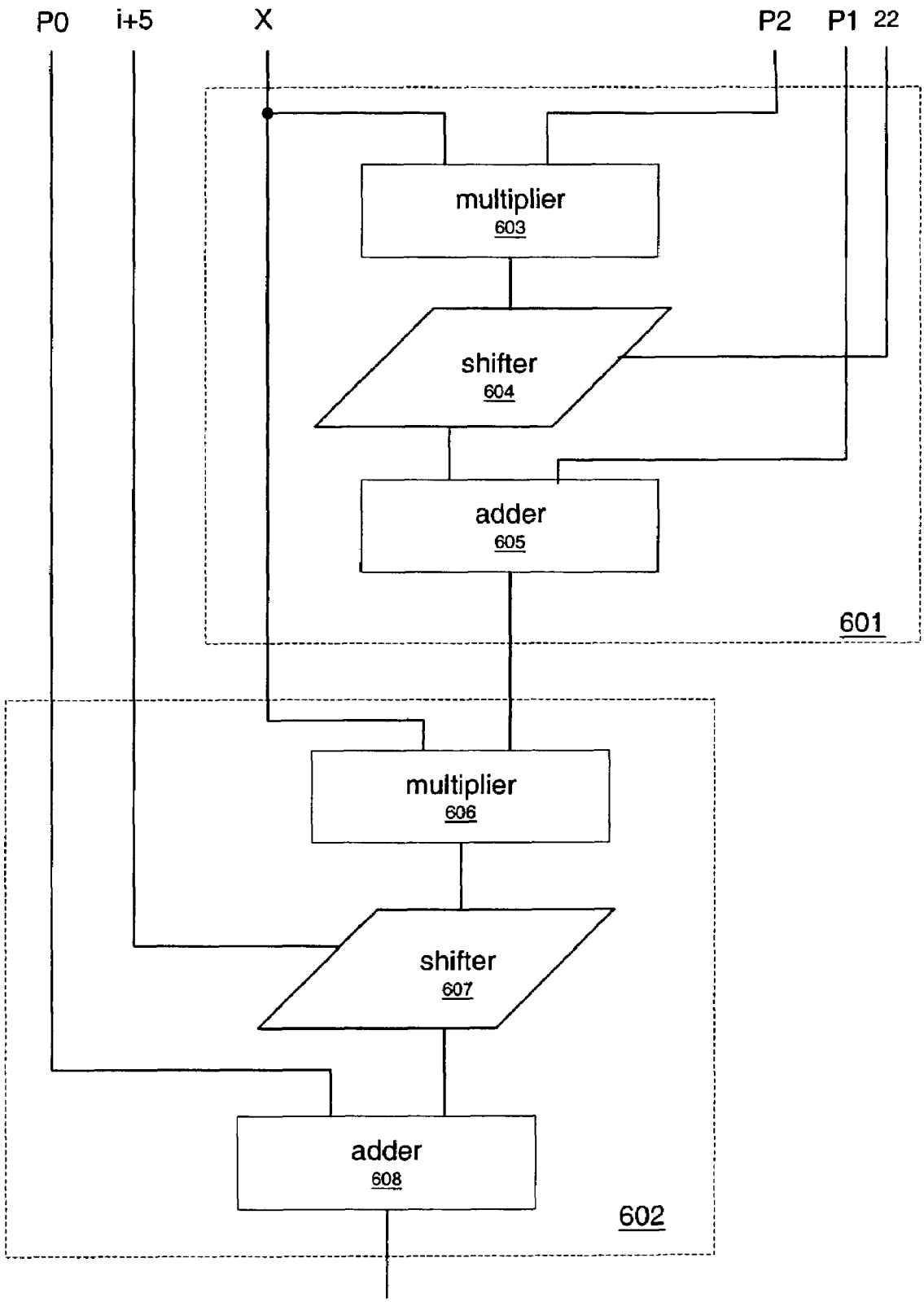
FIG. 6 is a block diagram of process logic to perform an enhanced Epharim-Malah filter weights operation.

FIG. 6 is a block diagram illustrating exemplary embodiment of operations in a fix-point implementation. Referring to FIG. 6, exemplary operation 600 includes a first operation 601 and a second operation 602. Operations 601 and 602 may be performed by hardware (e.g., circuitry, dedicated logic, etc.), software (such as programs run on a general purpose computer or a dedicated machine), or a combination of both. For example, blocks 601 and 602 may represent two circuits having individual components, such as multiplier, shifter, and adder, etc. Alternatively, blocks 601 and 602 may be embedded in a processor, such as a microprocessor. Furthermore, operations involved in blocks 601 and 602 may be implemented as an instruction recognized and executable by a processor, such as a CLZ instruction of Intel Xscale microprocessor. Other components apparent to those with ordinary skills in the art may be included.

According to one embodiment, processes involved in first operation 601 may be defined as follows:

$$TEMP = ((P2[i] \times X) >> (22 - ((i+5) - (i-4)))) - P1[i]$$
$$= ((P2[i] \times X) >> 13) - P1[i]$$

In a particular embodiment, first operation 601 includes a multiplier 603, a shifter 604, and an adder 605. Multiplier 603 multiplies P2 and X (mantissa) and generates a first intermediate value at an output of multiplier 603. Shifter 604 receives the first intermediate value from the output of multiplier 603 and shifts the intermediate value by a value of 22, resulting in a second intermediate value. Adder 605 adds the second intermediate value with P1 and generate an output Temp, as described above, of first operation 601.

According to one embodiment, processes involved in second operation 602 may be defined as follows:

$$M'(\theta) = ((X \times TEMP) >> (i+5)) + P0[i]$$

During second operation 602, multiplier 606 multiplies output Temp from the first operation 601 with mantissa X and generates a third intermediate value. Shifter 607 receives the third intermediate value and shifts a value of (i+5), where i is the index, and generates a fourth intermediate value. Adder 608 adds the fourth intermediate value with P0 and generates a final output representing M'(θ) described above. All processes described above do not invoke any mathematical division operations.

Figure 7:
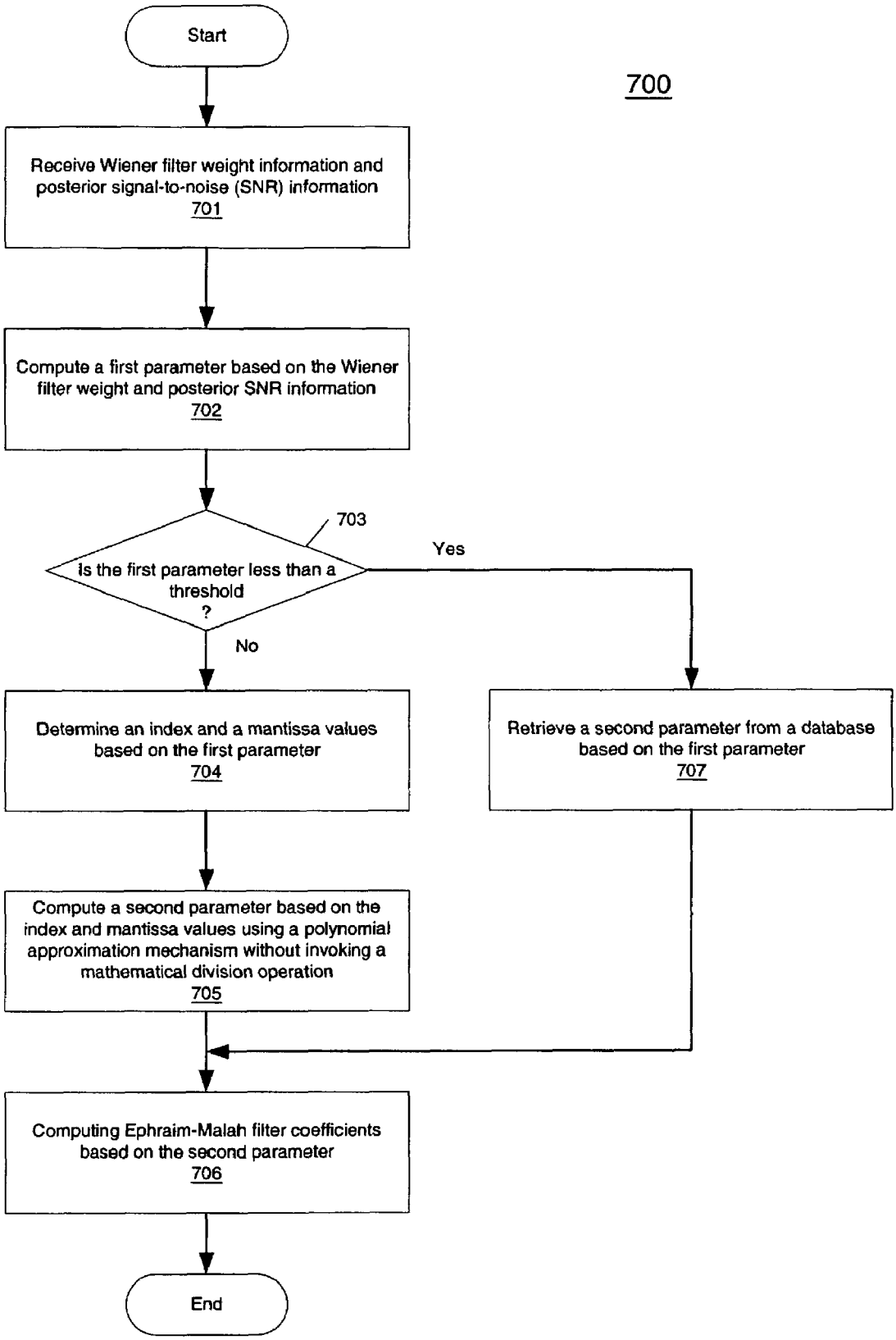
FIG. 7 is a flow diagram illustrating an exemplary embodiment of a process for an enhanced Epharim-Malah filter weights operation.

FIG. 7 is a flow diagram illustrating an exemplary embodiment of a process for generating Ephraim-Malah filter coefficients. The process may be performed by hardware (e.g., circuitry, dedicated logic, etc.), software (such as programs run on a general purpose computer or a dedicated machine), or a combination of both. In one embodiment, exemplary process 700 includes computing a first parameter based on Wiener filter weights and posterior signal-to-noise (SNR) via a polynomial approximation mechanism without using a mathematical division operation, and generating Ephrain-Malah filter coefficients based on the first parameter.

Referring to FIG. 7, at block 701, Wiener filter weights (e.g., $W_n^y(k)$) and posterior SNR (e.g., $\Re_n^{post}(k)$) are received. Wiener filter weights and posterior SNR may be obtained based on speech and noise power spectrum estimations which may be performed by speech and noise power spectrum estimation modules 104 and 103 of FIG. 1 respectively. At block 702, a first parameter (e.g., θ) is computed based on the Wiener filter weights and posterior SNR. In one embodiment, the first parameter is a 32-bit value. At block 703, if the first parameter is equal to or less than a threshold, a second parameter (e.g., M'(θ)) is retrieved from a database based on the first parameter, at block 707. In one embodiment, the threshold is defined as $2^7$. According to one embodiment, the database includes one or more data tables that store the second parameter corresponding to the first parameter. Thereafter, at block 706, Ephraim-Malah filter coefficients are computed based on the second parameter.

If the first parameter is greater than the threshold, at block 704, an index and a mantissa are determined based on the first parameter. In one embodiment, the index is determined based on the number of the leading zero of the first parameter and the mantissa is determined based in part on the remaining portion of the first parameter, such as for example, parameter 550 shown in FIG. 5B. At block 705, a second parameter (e.g., M'(θ)) is computed based on the index and mantissa using a polynomial approximation mechanism without invoking a mathematical division operation. In one embodiment, the polynomial approximation mechanism includes a two-order polynomial approximation operation, which may be defined as follows:

$$f(x)=P0+P1*x+P2*x^2$$

In one embodiment, P0 is in a Q22 format. P1 is determined based on a dynamic Q value of (5+i), where i is an index value. P2 is determined based on a dynamic Q value of (i−4), where i is an index value. At block 706, Ephraim-Malah filter coefficients are computed based on the second parameter.

Figure 8:
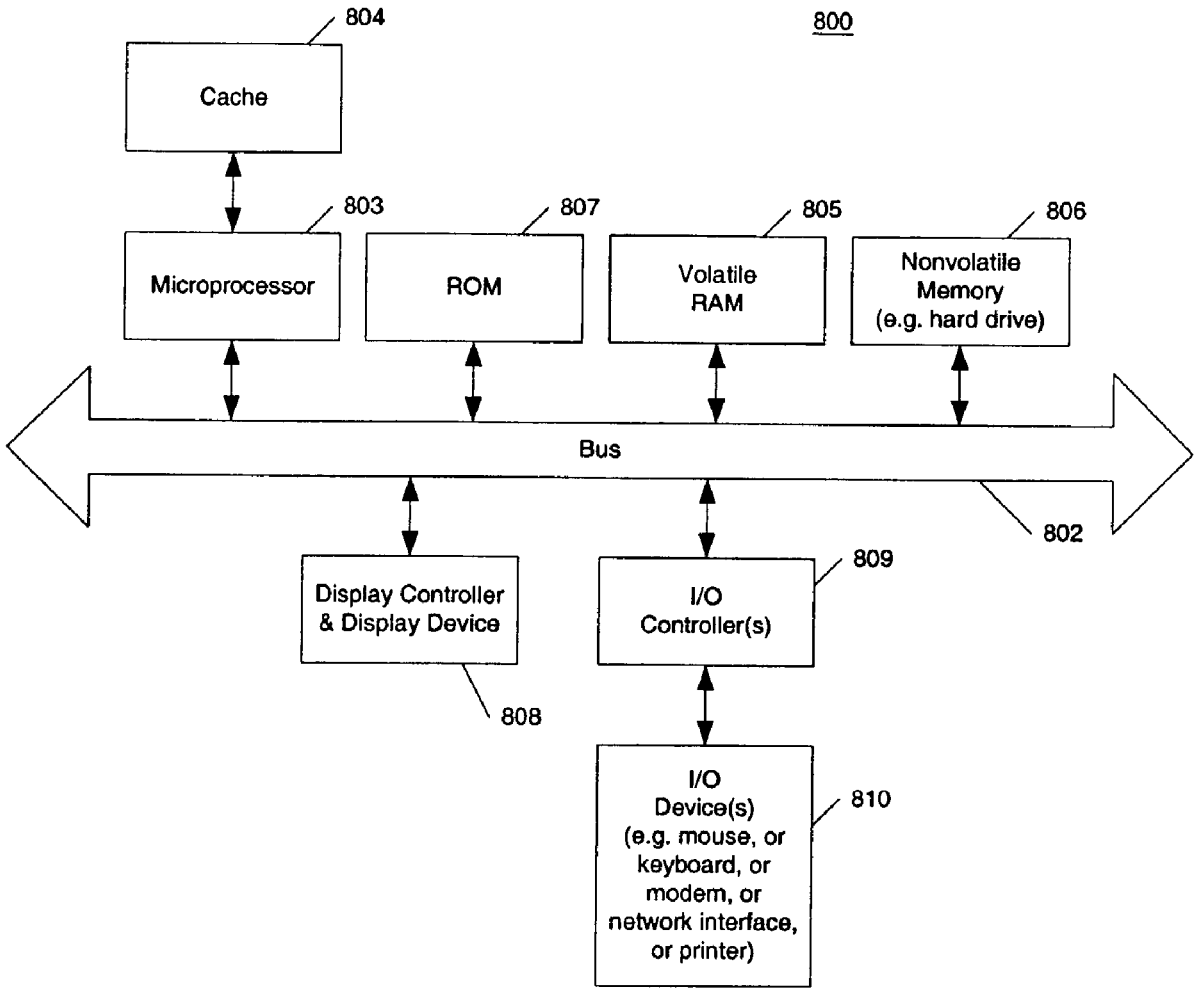
FIG. 8 is a block diagram of an exemplary computer system which may be used to execute an enhanced Epharim-Malah filter weights operation.

FIG. 8 shows a block diagram of an exemplary computer which may be used with an embodiment of the invention. For example, system 800 shown in FIG. 8 may include hardware, software, or the both, to perform the above discussed processes shown in FIGS. 5A, 6, and 7. Note that while FIG. 8 illustrates various components of a computer system, it is not intended to represent any particular architecture or manner of interconnecting the components, as such details are not germane to the present invention. It will also be appreciated that network computers, handheld computers, cell phones, and other data processing systems which have fewer components or perhaps more components may also be used with the present invention.

As shown in FIG. 8, the computer system 800, which is a form of a data processing system, includes a bus 802 which is coupled to a microprocessor 803 and a ROM 807, a volatile RAM 805, and a non-volatile memory 806. The microprocessor 803, which may be a Pentium processor from Intel Corporation, is coupled to cache memory 804 as shown in the example of FIG. 8. The bus 802 interconnects these various components together and also interconnects these components 803, 807, 805, and 806 to a display controller and display device 808, as well as to input/output (I/O) devices 810, which may be mice, keyboards, modems, network interfaces, printers, and other devices which are well-known in the art. Typically, the input/output devices 810 are coupled to the system through input/output controllers 809. The volatile RAM 805 is typically implemented as dynamic RAM (DRAM) which requires power continuously in order to refresh or maintain the data in the memory. The non-volatile memory 806 is typically a magnetic hard drive, a magnetic optical drive, an optical drive, or a DVD RAM or other type of memory system which maintains data even after power is removed from the system. Typically the non-volatile memory will also be a random access memory, although this is not required. While FIG. 8 shows that the non-volatile memory is a local device coupled directly to the rest of the components in the data processing system, it will be appreciated that the present invention may utilize a non-volatile memory which is remote from the system, such as a network storage device which is coupled to the data processing system through a network interface such as a modem or Ethernet interface. The bus 802 may include one or more buses connected to each other through various bridges, controllers, and/or adapters, as is well-known in the art. In one embodiment, the I/O controller 809 includes a USB (Universal Serial Bus) adapter for controlling USB peripherals.

Precision piecewise polynomial approximation for Ephraim-Malah filter has been described herein. In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A computer-implemented method for processing speech data, the method comprising:

in response to input speech data, performing speech power spectrum estimation and noise power spectrum estimation, generating Wiener filter weights and posterior signal-to-noise (SNR);

computing a first parameter based on the Wiener filter weights and the posterior SNR;

determining a second parameter by performing a polynomial approximation operation based on the first parameter without using a mathematical division operation;

generating Ephrain-Malah filter coefficients based on the second parameter;

invoking an Ephrain-Malah filter to perform a filtering operation on the input speech data using the Ephrain-Malah filter coefficients to reduce noise from the input speech data, generating output speech data; and playing the output speech data using a speech data sink device.

2. The method of claim 1, further comprising:

determining whether the first parameter is less than a predetermined threshold; and determining the second parameter by performing a lookup operation in a lookup table in view of the first parameter if the first parameter is less than the predetermined threshold.

3. The method of claim 2, wherein the predetermined threshold is $2^7$.

4. The method of claim 2, wherein if the first parameter is not less than the predetermined threshold, the method further comprises:

determining an index value and a mantissa value based on the first parameter; and computing the second parameter based on the index and mantissa values via the polynomial approximation operation.

5. The method of claim 4, wherein the second parameter is determined further based on a third parameter in combination with the index and mantissa values, and wherein the third parameter is dynamically selected based in part on the index value.

6. The method of claim 4, wherein the computing the second parameter based on the index and mantissa values includes a first coefficient, a second coefficient dynamically determined based in part on the index value, the method further comprises:

performing via a first multiplier a multiplication of the first coefficient with the mantissa value, resulting in a first intermediate value;

performing via a first shifter a shift operation on the first intermediate value by a predetermined value, resulting in a second intermediate value; and performing via a first adder an addition on the second intermediate value with the second coefficient, resulting in a third intermediate value.

7. The method of claim 6, wherein the computing the second parameter based on the index and mantissa values includes a third coefficient, the method further comprises:

performing a second multiplier a multiplication of the third intermediate value with the mantissa value, resulting in a fourth intermediate value;

performing a second shifter a shift operation on the fourth intermediate value by a value determined based in part on the index value, resulting in a fifth intermediate value; and performing a second adder an addition on the fifth intermediate value with the third coefficient to generate the second parameter.

8. The method of claim 4, wherein the index value is determined based on number of leading zero of the first parameter.

9. The method of claim 8, wherein the mantissa value is determined based in part on a remainder of the first parameter.

10. The method of claim 1, wherein the polynomial approximation operation is represented by a function of $f(x)=P0+P1*x+P2*x^2$, wherein P0 is in a Q22 format, wherein P1 represents a dynamic Q value of (5+i) and P2 represents a dynamic Q value of (i-4), and wherein i represents an index derived from the first parameter.

11. A machine-readable storage medium having executable code to cause a machine to perform a method for processing speech data, the method comprising:

in response to input speech data, performing speech power spectrum estimation and noise power spectrum estimation, generating Wiener filter weights and posterior signal-to-noise (SNR);

computing a first parameter based on the Wiener filter weights and the posterior SNR;

determining a second parameter by performing a polynomial approximation operation based on the first parameter without using a mathematical division operation;

generating Ephrain-Malah filter coefficients based on the second parameter;

invoking an Ephrain-Malah filter to perform a filtering operation on the input speech data using the Ephrain-Malah filter coefficients to reduce noise from the input speech data, generating output speech data; and playing the output speech data using a speech data sink device.

12. The machine-readable storage medium of claim 11, wherein the method further comprises:

determining whether the first parameter is less than a predetermined threshold; and determining the second parameter by performing a lookup operation in a lookup table in view of the first parameter if the second parameter is less than the predetermined threshold.

13. The machine-readable storage medium of claim 12, wherein the predetermined threshold is $2^7$.

14. The machine-readable storage medium of claim 12, wherein if the first parameter is not less than the predetermined threshold, the method further comprises:

determining an index value and a mantissa value based on the first parameter; and computing the second parameter based on the index and mantissa values via the polynomial approximation operation.

15. The machine-readable storage medium of claim 14, wherein the second parameter is determined further based on a third parameter in combination with the index and mantissa values, and wherein the third parameter is dynamically selected based in part on the index value.

16. The machine-readable storage medium of claim 14, wherein the computing the second parameter based on the index and mantissa values includes a first coefficient, a second coefficient dynamically determined based in part on the index value, the method further comprises:

performing a first multiplier a multiplication of the first coefficient with the mantissa value, resulting in a first intermediate value;

performing a first shifter a shift operation on the first intermediate value by a predetermined value, resulting in a second intermediate value; and performing a first adder an addition on the second intermediate value with the second coefficient, resulting in a third intermediate value.

17. The machine-readable storage medium of claim 16, wherein the computing the second parameter based on the index and mantissa values includes a third coefficient, the method further comprises:

performing a second multiplier a multiplication of the third intermediate value with the mantissa value, resulting in a fourth intermediate value;

performing a second shifter a shift operation on the fourth intermediate value by a value determined based in part on the index value, resulting in a fifth intermediate value; and performing a second adder an addition on the fifth intermediate value with the third coefficient to generate the second parameter.

18. The machine-readable storage medium of claim 14, wherein the index value is determined based on number of leading zero of the first parameter.

19. The machine-readable storage medium of claim 18, wherein the mantissa value is determined based in part on a remainder of the first parameter.

20. The machine-readable storage medium of claim 11, wherein the polynomial approximation operation is represented by a function of $f(x)=P0+P1*x+P2*x^2$, wherein P0 is in a Q22 format, wherein P1 represents a dynamic Q value of (5+i) and P2 represents a dynamic Q value of (i−4), and wherein i represents an index derived from the first parameter.

21. An apparatus, comprising:

an input interface to receive input speech data;

a power spectrum estimator to perform a speech power spectrum estimation and a noise power spectrum estimation to obtain Wiener filter weights and posterior signal-to-noise (SNR) and to generate a first parameter based on the Wiener filter weights and posterior SNR;

a polynomial approximation unit to perform a polynomial approximation operation on the first parameter without using a mathematical division operation to generate a second parameter and to generate Ephrain-Malah filter coefficients based on the second parameter;

an Ephrain-Malah filter to perform a filtering operation on the input speech data using the Ephrain-Malah filter coefficients to reduce noise from the input speech data, generating output speech data; and a speech data sink device to play the output speech data.

22. The apparatus of claim 21, further comprising a lookup table to provide the second parameter if the first parameter is less than a predetermined threshold.

23. The apparatus of claim 21, wherein the polynomial approximation unit comprises:

a first multiplier to perform a multiplication of a first coefficient with a mantissa value derived from the Wiener filter weights and SNR, resulting in a first intermediate value;

a first shifter to perform a shift operation on the first intermediate value by a predetermined value, resulting in a second intermediate value; and a first adder to perform an addition on the second intermediate value with a second coefficient, resulting in a third intermediate value.

24. The apparatus of claim 23, wherein the polynomial approximation unit further comprises:

a second multiplier to perform a multiplication of the third intermediate value with the mantissa value, resulting in a fourth intermediate value;

a second shifter to perform a shift operation on the fourth intermediate value by a value determined based in part on the index value, resulting in a fifth intermediate value; and a second adder to perform an addition on the fifth intermediate value with a third coefficient to generate the second parameter.

25. The apparatus of claim 21, wherein the polynomial approximation operation is represented by a function of $f(x)=P0+P1*x+P2*x^2$, wherein P0 is in a Q22 format, wherein P1 represents a dynamic Q value of (5+i) and P2 represents a dynamic Q value of (i−4), and wherein i represents an index derived from the first parameter.

26. A system, comprising:

a processor; and a memory coupled to the processor, the memory storing instructions, which when executed by the processor, cause the processor to perform the operations of:

in response to input speech data, performing speech power spectrum estimation and noise power spectrum estimation, generating Wiener filter weights and posterior signal-to-noise (SNR), computing a first parameter based on the Wiener filter weights and the posterior SNR, determining a second parameter by performing a polynomial approximation operation based on the first parameter without using a mathematical division operation, generating Ephrain-Malah filter coefficients based on the second parameter, and invoking an Ephrain-Malah filter to perform a filtering operation on the input speech data using the Ephrain-Malah filter coefficients to reduce noise from the input speech data, generating output speech data to be used by an audio processing logic.

27. The apparatus of claim 26, further comprising a lookup table stored in the memory to provide the second parameter if the first parameter is less than a predetermined threshold.

28. The apparatus of claim 26, further comprising a first operation module coupled to the processor and the memory, the first operation module including:

a first multiplier to perform a multiplication of a first coefficient with a mantissa value derived from the Wiener filter weights and SNR, resulting in a first intermediate value;

a first shifter to perform a shift operation on the first intermediate value by a predetermined value, resulting in a second intermediate value; and a first adder to perform an addition on the second intermediate value with a second coefficient, resulting in a third intermediate value.

29. The apparatus of claim 28, further comprising a second operation module coupled to the processor and the memory, the second operation module including:

a second multiplier to perform a multiplication of the third intermediate value with the mantissa value, resulting in a fourth intermediate value;

a second shifter to perform a shift operation on the fourth intermediate value by a value determined based in part on the index value, resulting in a fifth intermediate value; and a second adder to perform an addition on the fifth intermediate value with a third coefficient to generate the second parameter.

30. The system of claim 26, wherein the polynomial approximation operation is represented by a function of $f(x)=P0+P1*x+P2*x^2$, wherein P0 is in a Q22 format, wherein P1 represents a dynamic Q value of (5+i) and P2 represents a dynamic Q value of (i−4), and wherein i represents an index derived from the first parameter.

* * * * *